United States Patent [19]

Lipscomb et al.

[11] 4,147,749

[45] Apr. 3, 1979

[54] VARIED ORIENTATION OF FIBERS

[75] Inventors: Walter P. Lipscomb, Chester; John R. McKlveen, Colonial Heights; Garland L. Turner, Chesterfield, all of Va.

[73] Assignee: Allied Chemical Corporation, Morris Township, Morris County, N.J.

[21] Appl. No.: 725,617

[22] Filed: Sep. 22, 1976

Related U.S. Application Data

[60] Continuation of Ser. No. 604,754, Aug. 14, 1975, abandoned, which is a continuation of Ser. No. 322,654, Jan. 11, 1973, abandoned, which is a division of Ser. No. 87,030, Nov. 5, 1970, abandoned.

[51] Int. Cl.[2] ..... D01D 5/20

[52] U.S. Cl. ..... 264/167; 264/210 F; 264/290 N

[58] Field of Search ..... 264/290 T, 167, 210 F

[56] References Cited

U.S. PATENT DOCUMENTS

| | | | |
|---|---|---|---|
| 2,324,397 | 7/1943 | Hull | 264/176 F |
| 3,102,323 | 9/1963 | Adams | 264/167 |
| 3,185,613 | 5/1965 | Adams | 264/290 T |
| 3,275,732 | 9/1966 | Macleod et al. | 264/290 T |
| 3,363,295 | 1/1968 | Allen | 264/290 T |
| 3,389,207 | 6/1968 | Macleod et al. | 264/290 T |
| 3,480,709 | 11/1969 | Jacob et al. | 264/237 |

FOREIGN PATENT DOCUMENTS

| | | | |
|---|---|---|---|
| 42-2011 | 1/1967 | Japan | 264/168 |

*Primary Examiner*—Jay H. Woo
*Attorney, Agent, or Firm*—Fred L. Kelly

[57] ABSTRACT

Fibers are produced from synthetic polymeric materials having randomly produced sections of high and low orientation and varying cross-section areas. The varied orientation and cross-section areas are produced by quickly cooling the fiber and drawing said fiber below its natural draw ratio.

1 Claim, 5 Drawing Figures

Figure 1:
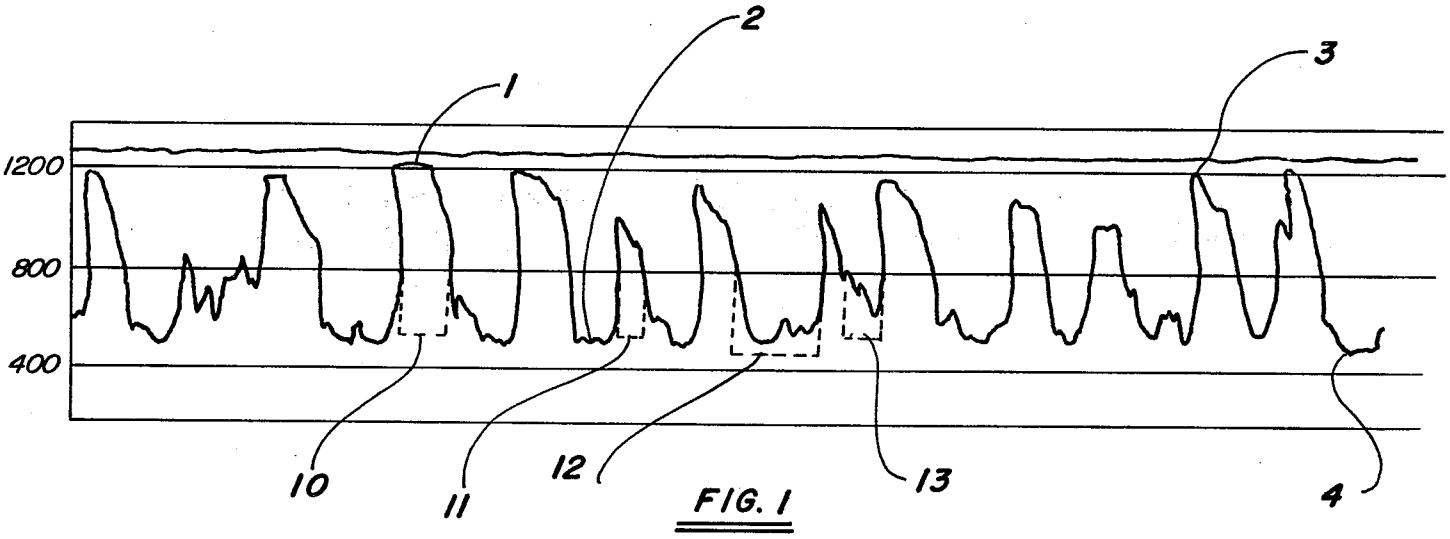

INVENTORS
Walter P. Lipscomb
Garland L. Turner
John R. McKiveen

BY Ry H Massengill
ATTORNEY

INVENTORS
Walter P. Lipscomb
Garland L. Turner
John R. McKiveen
BY
ATTORNEY

INVENTORS
Walter P. Lipscomb
Garland L. Turner
John R. McKiveen
BY Ray H Massengill
ATTORNEY

VARIED ORIENTATION OF FIBERS

This is a continuation of application Ser. No. 604,754 filed Aug. 14, 1975 which is a continuation of application Ser. No. 322,654 filed Jan. 11, 1973 which is a division of application Ser. No. 87,030 filed Nov. 5, 1970, all abandoned.

BACKGROUND AND PRIOR ART

The use of high oriented and low oriented fiber blends in the same fabric is known in the textile art. Low oriented fibers are more susceptible to the action of heat, solvents, reactants, dye stuffs, and adhesives, and in many instances can be employed to aid fusion bonding or otherwise modify fabric properties. In order to increase the tenacity of high polymer strands such as those produced by melt-spinning nylon, it has been the usual practice to draw them to textile filaments of high strength, under temperatures of 20° to 300° C. whereby the fiber molecules are oriented and the fibers made stronger, more durable, etc. The drawing extension used varies from slightly over 1 to 1 to 11 to 1 or more to suit the particular polymer structure, molecular weight, crystalline properties, etc. It was discovered early that to gain adequate and uniform strength for subsequent processes in every segment along the filament length, certain polymer types, such as the nylons, polyesters, polyolefins, etc., must be drawn to a certain minimum draw ratio. This minimum extension became known as "natural draw ratio" to the art. By "natural draw ratio" is meant that draw ratio which is reached just prior to a sharp increase in pulling force being required to further extend or stretch a filament. This property can be the conventional plotting of a stress-strain curve during drawing of an undrawn filament. Natural draw ratio is defined by Marshall and Thompson, J. Applied Chemistry 4, 145 (1954). The actual numerical value of "natural draw ratio" varies with polymer properties, extrusion conditions, and drawing conditions for any specific polymer type.

The instant invention violates several of the classic concepts of drawing to achieve a novel, useful product, i.e., by drawing at a temperature below accepted minimum temperatures, even those used for so-called "cold draw". The term "cold draw" as generally referred to in the art is inaccurately named since conversion of mechanical energy to thermal energy during drawing imparts heat to the filaments at the actual draw point. The novel product of this invention is produced by attenuation of the filaments below the natural draw ratio of the given filaments without imparting strand portions of variable diameter which are too weak for further processing by usual means. This quite unexpected result appears to be due to a fixation of the essentially unoriented thick section structure so it will not readily extend under stress as a normal unoriented structure is prone to do. The most significant, novel property of the fibers of this invention is that a random distribution of sections of unlike cross-sectional area produces certain desired properties without sacrificing other desirable properties. These unlike sections are comprised of oriented and unoriented molecules, respectively, whereby the fibers and fabric containing the same have drawn and undrawn yarn characteristics. Thus, besides the variation in cross-section size, the filaments of this invention show variations in dye receptivity, sheen, elasticity, and sticking temperature between small and large diameter segments.

SUMMARY

The present invention involves the discovery that non-uniformity in cross-section in the same filament, if produced by quickly contacting a spun polymer with a cooling device, −20° to +20° C., while drawing can provide novel characteristics and properties to the filament and articles produced therefrom. The primary object of the present invention is to provide such filaments or yarns, novel articles containing the same, and processes for producing the filaments and articles. This yarn (or filament) when randomly formed into a non-woven fabric, for example, modifies the physical properties of the fabric so that improved high tensile and tear strength are obtained while at the same time increased resistance to puncture by sharp objects and other advantages of low oriented yarn are gained. Moreover, the material is more resistant to sudden tensile stress applications and has a better drape due to controllable bonding-elastic fiber patterns. For ease of reference and for descriptiveness the non-uniform cross-section fibers shall hereafter sometimes be referred to simply as "thick-thin."

The thick-thin filaments can be laid as a random mat or batt by the usual non-woven web processes and apparatus and then bonded by fusion, adhesive or reactive-solvent type processes. The low-oriented sections fuse more readily than high-oriented sections. Also, they are penetrated more readily by solvents, reactants, certain dye stuff, and adhesives. Since, as in the conventional bonding systems, bonds are produced mainly on the undrawn sections, the major bond connecting members in the articles of this invention are of high orientation. This produces a fabric with strength like all high-oriented filaments, yet adds a flexibility at the bonds that improves drape, tear and puncture strength, and facilitates improved sewing or tufting.

Figure 2A:
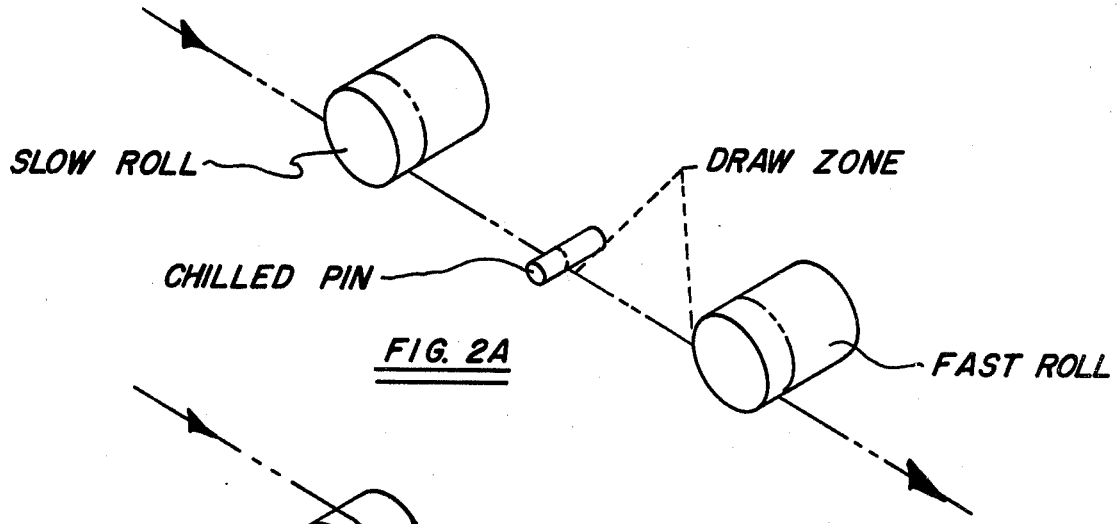
Figure 2B:
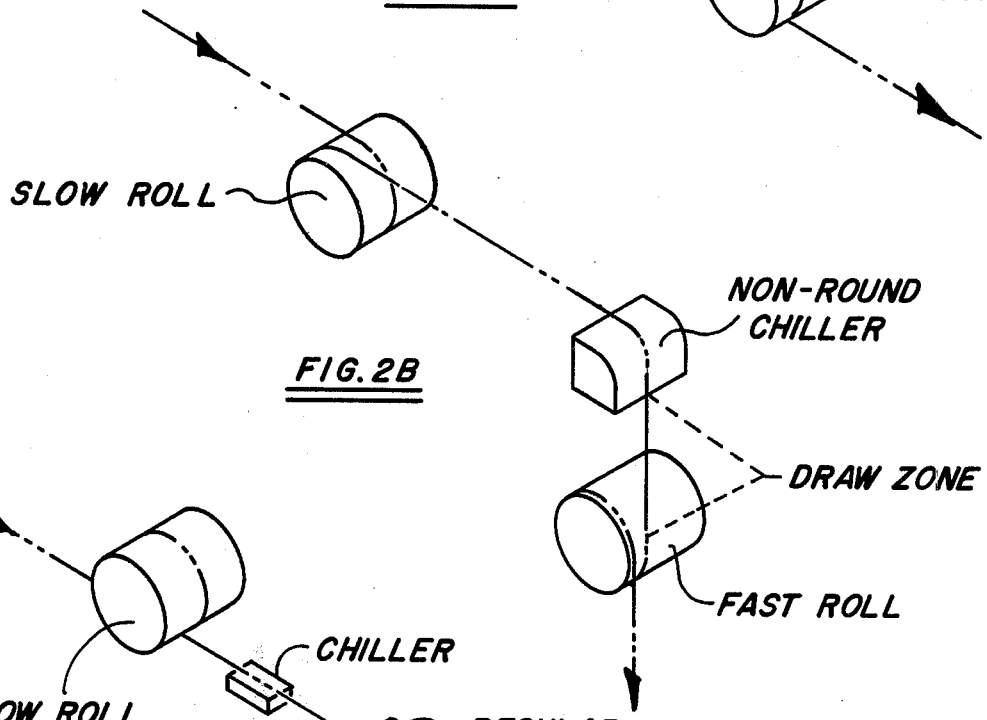
Figure 2C:
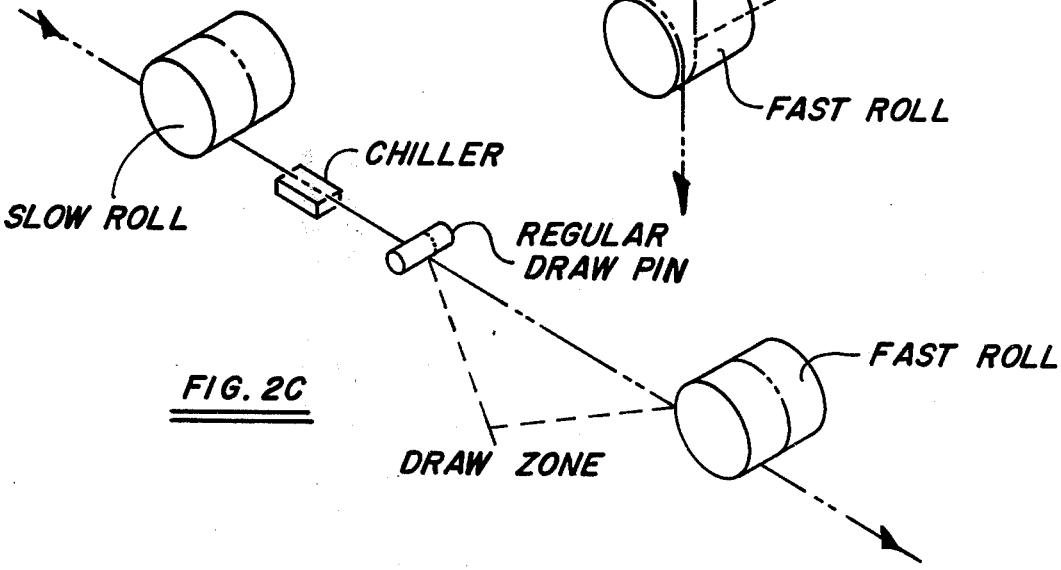
Figure 3:
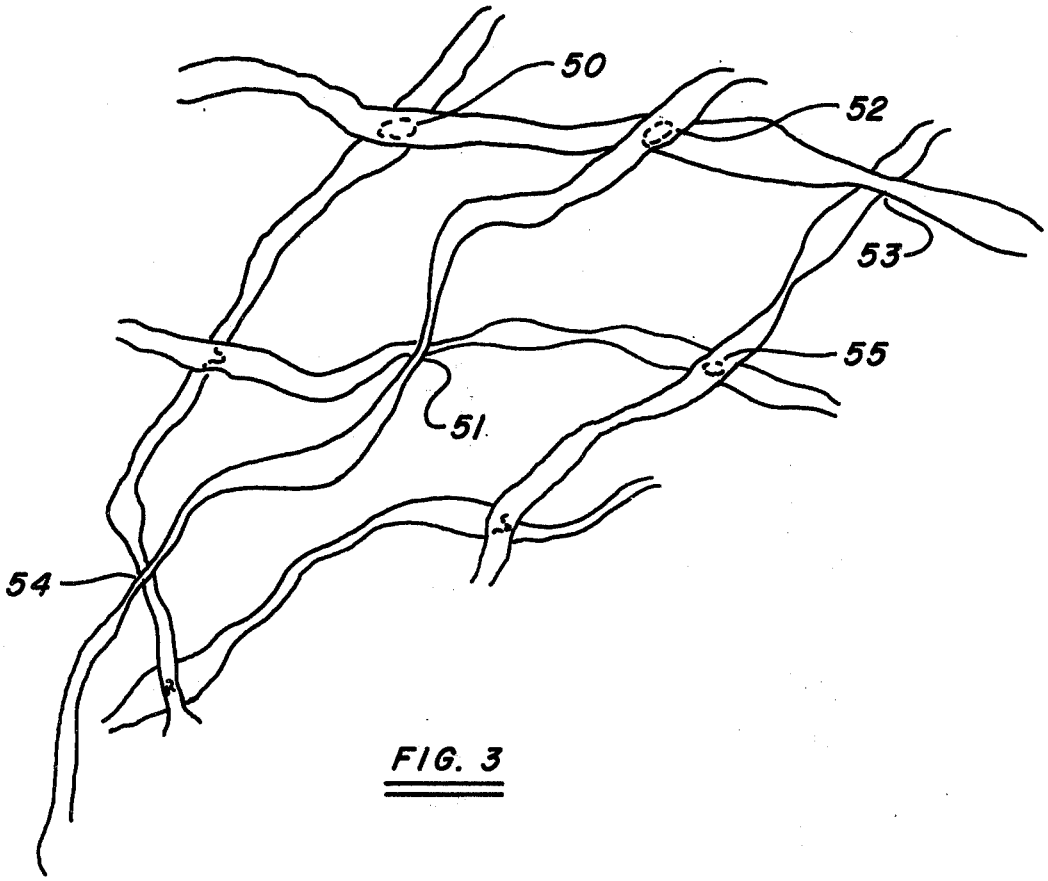

Other objects and advantages of the present invention will become apparent to those skilled in this art from the appended claims and following description of the best mode of carrying out the invention and examples thereof made in connection with the accompanying drawings wherein FIG. 1 is a graphic illustration of the diameter of the novel filaments hereof;

FIG. 2 is a schematic illustration of the equipment and process of the invention; and FIG. 3 is a diagrammatic sketch of a portion of a fabric made in accordance with the invention.

DESCRIPTION

The preferred method of making thick-thin filaments utilizes more or less conventional drawing equipment with a cooling zone, but otherwise little or no extra mechanical equipment is required. Undrawn yarn, cooled below the second order transition temperature to create an instability therein and drawn below the natural draw ratio will produce a yarn in which random portions remain essentially undrawn. The complete theory as to why the varying areas are produced is not completely understood, but the fast drawing after quick, brief cooling creates the instable areas and energy transfer during drawing is somewhat erratic. The time of cooling is thought to be important and should not be less than 0.001 second nor more than 0.1 second, and temperature of the filaments should be controlled within the range of −20° C. to +20° C.

The thermodynamics could be described as:

$E_D$ = Internal energy necessary for all of the yarn to draw $E_N$ = Internal energy level where no yarn will draw $E_Y$ = Internal energy of yarn then:

| | |
|---|---|
| (1) | $E_N < E_Y < E_D$ |
| (2 A) | $E_Y = (E_D -$ heat energy removed) |
| or | |
| (2 B) | $E_Y - E_N \neq 0$ |
| (2 C) | heat energy removed must be greater than 0 |

and:

if $t_c$ = critical time for equilization of internal energy within a yarn, the sum of the contact time in chilled zone and time from chiller to draw point must be less than $t_c$ In accordance with the present invention, yarn initially in a drawable condition is chilled at the draw point or immediately before the draw point to below 20° C. and a contact time of less than 0.1 second, preferably −10° to 10° C. for a period of 0.01 to 0.05 second so that enough heat is removed from the yarn to render only a portion of said yarn undrawable. The yarn is drawn to a draw ratio of greater than 1.0 but less than the natural draw ratio, preferably 1.3 to 3.0. The denier ratio should be at least 1.75 and preferably above 2.0. By denier ratio is meant the average denier of the slub portions divided by the average denier of the thin portions of a given filament. The amount of heat removed has been found to be rather critical in accomplishing the objects of this invention. Should too much heat be removed the yarn either breaks or has uniform denier which does not possess the unique properties of the yarn of the present invention. Thus, the conditions under which the yarn is chilled must be accurately controlled.

The thick-thin filaments of this invention differ from the conventional thick-thin filaments in that the thick sections are stronger and have a lower ultimate elongation (UE) than the undrawn thick sections of the conventional filaments. Therefore, in a non-woven fabric, these unique filaments improve the tear strength without a substantial loss of strength or increase of elongation at break to overcome these deficiencies which occur when conventional thick-thin filaments are employed in non-woven fabrics.

Although various drawing means and arrangements can be devised to create thick-thin filaments it is preferable to utilize a simple feed roll, draw roll, intermediate chiller or cold plate and draw pin (chilled if desired) arrangement.

Any thermoplastic suitable for fiber formation can be used to accomplish the desired results of this invention. These include the various polyamides such as nylon 6, 6/6, 6/10, methanol- and ethanol-soluble polyamide copolymers and other substituted polyamides such as the alkoxy-substituted polyamides, etc.; polyesters such as polyethylene terephthalate; polyolefins such as polyethylene, polypropylene, poly-1-butene, poly-2-butene, polyisobutylene and polystyrene; polysulfones; polyphenyloxides; polycarbonates; and the like. Good results have also been obtained utilizing multi-constituent filaments having a nylon matrix, microfibers of polyester dispersed therein, as described and claimed in Twilley U.S. Pat. No. 3,369,057, which patent is incorporated by reference herein for the purpose of such description.

The variation of properties and section lengths of unlike cross-section size occurs in a random pattern, yet the overall average pattern can be controlled. While most textile drawing processes to produce desirable effects seem to become less efficient and more difficult as linear speeds increase, the thermodynamic thick-thin process hereof gives equivalent results at maximum machine speeds or usual draw speeds.

The variation of elastic properties and sticking temperatures of the thick-thin filaments is particularly useful for producing non-woven fabrics. The random variation of sticking temperatures yields random bonding points in fusion bonded webs. The variation of elastic properties produces a fabric with superior physical properties, particularly tear and impact resistance. The application of a localized force causes a very small extension at the thick points thus propagating the load, but the unique nature of these sections causes them to rapidly become stiff. The random occurrence of the thick segments helps dissipate forces on a micro scale with no noticeable fabric damage. It was also found that the variation in dye receptivity was concurrent with variation in response to adhesives and penetrating agents. Therefore, non-woven fabrics using such agents also gain enhanced physical, optical and aesthetic properties from the use of the thermodynamic thick-thin filaments of this invention.

FIG. 1 illustrates a continuous graph of yarn diameter measured with a Uster Evenness Tester for comparison of an undrawn yarn and a thermodynamic thick-thin yarn. Both samples were tested under similar conditions. Points 1 and 3 show that a slight diameter reduction occurs in the thickest yarn segments, while points 2 and 4 emphasize the large reduction of diameter at some parts of the filament. Lengths 10, 11, 12 and 13 indicate the randomness of the variations in diameter achieved.

The extruded, yet undrawn, filaments are treated in a conventional manner to render them drawable. As illustrated in FIG 2A, the filaments, which may or may not require preheating to render them extensible, are moved forward by a feed device to a draw zone. Heat is removed, as by a cooled draw pin, which can either be immediately before or at the actual draw point. FIG. 2B illustrates a variation wherein a non-round chiller is substituted for the pin, and FIG. 2C shows a chilling device installed in a machine using a regular draw pin.

Virtually, any size or weight filament can be used in the present invention, making appropriate adjustments when necessary in relation to the physical properties thereof. For example, yarn deniers from 30 to 2,000 are preferred at draw speeds up to 2,600 ft. per minute but with fiber yarn denier below 300, care must be taken to prevent the draw point from shifting out of the chilled zone as by using a regular draw pin with the chiller.

The following example of the preferred mode of carrying out the invention illustrates the principles thereof.

EXAMPLE 1

Nylon 6 polymer of about 55 Relative Formic Acid Viscosity was extruded through a die having 20 capillaries of 0.014 inch diameter of a temperature of 260° C. The filaments were quenched in conditioned air and wound on a package at 500 meters per minute to form a 1400 denier undrawn yarn. These yarns were stored at 25° C. and 35–40% relative humidity for subsequent processing.

The yarns were drawn on a draw winder which had the usual draw pin replaced by a 1-inch diameter hollow stainless steel tube with chilled brine circulating through it to give a surface temperature of 6° C. Yarn was fed to the pin by an 80 mm diameter roll rotating at 550 RPM. Another 80 mm diameter roll spaced 24 cm. from the pin was rotated at 1100 RPM to attenuate the yarn by a factor of 2:1.

The yarns thus produced are listed in Table I, below, Examples 2–6 all being nylon 6 materials.

Example 11, Table II was made similar to the above, except the chilled tube was replaced by a regular draw pin and a chilled plate placed immediately before the pin.

A small sample similar to Example 11 was made using a Peltier cooler 2 inches square for the chilled plate. This cooler was switched off and on quickly and visual observation showed quite clearly that the undrawn lacunose slubs appeared only when the cooler was on.

Drawing conditions for nylon 6 were controlled within the following limits in the Examples herein:

1. The filament internal energy was reduced by at least $1.5 \times 10^{-3}$, but no more than $4.5 \times 10^{-3}$ calories per meter per denier.
   ($E_D - E_Y = 1.5 \times 10^{-3}$ to $4.5 \times 10^{-3}$ Cal./m./den.)
2. Contact time from leading edge of chiller to draw point was 0.001 to 0.1 seconds.
   ($t_c = 0.001$ to 0.1 sec.)
3. The rate of heat removal from the filaments was at least $5 \times 10^2$ to $12 \times 10^3$ calories per gram per second.
   ($d_E/d_t = 5 \times 10^2$ to $12 \times 10^3$ Cal./gm./sec.)

conditions with the listed product properties obtained therefrom. Examples 7–10 were 1450 undrawn denier, 64 filaments and Examples 11–17 were 400 undrawn denier, 20 filaments.

From the foregoing, it is apparent that the process of this invention is limited to carrying out the drawing step under temperature ranging from −20° C. to +20° C. and particularly for nylon 6, preferably etween −10° and +10° C. Likewise, the preferred contact time between the drawn filament and cooling device is approximately 0.05 seconds, although this can be carried between 0.001 and 0.1 second. Lastly, the draw ratio ranges between 1.3 and an increment of 0.2 below the natural draw ratio of the yarn used, preferably in the range of 1.5 to 3.0, particularly for nylon 6.

Table III demonstrates variations in knitted fabric properties depending on different yarn drawing conditions. The yarn used in Examples 18–22 was nylon 6.

EXAMPLES 23 to 26

Referring to Table IV, filaments of nylon 6 were formed by extruding a 70 FAV polymer by the usual means to give a 30 denier per filament fiber. A portion of these filaments was attenuated by an effective draw ratio of 5 to 1, draft and predraft. The drawn filaments were formed into a randomly oriented web, then fusion bonded to a coherent structure by heat and pressure. The properties of the drawn fiber fabric are shown in Example 23. Some of the 30 denier undrawn filaments were formed into a similar web and bonded with slightly less heat and pressure illustrated as Example 24. Example 25 is the same as 24, but bonded at the same conditions as the drawn yarn. Example 26 was made from filaments drawn at a 1.8 to 1 draw by the thick-thin technique.

TABLE I

| Example No. Description | 2 | 3 | 4 | 5 | 6 |
|---|---|---|---|---|---|
| Yarn Angle of Contact with Draw Point Fixing Means | 100±10 | 400±20 | 100±10 | 400±20 | 90±10 |
| Undrawn Slub Length, $\bar{X}$ cm | 10.0 | 12.9 | 9.0 | 10.0 | 5.9 |
| Slub Length, max. cm | 15.6 | 34.5 | 27.6 | 17.3 | 10.2 |
| Slub Length, min. cm | 4.6 | 4.4 | 3.3 | 5.7 | 3.3 |
| Randomness Length Slub = Maximum/Minimum | 3.4 | 7.9 | 8.4 | 3.0 | 3.1 |
| Slub Total Drawing | 166% | 156% | 150% | 180% | 250% |
| Thin Section Length cm Average | 17.4 | 20.6 | 16.8 | 23.1 | 13.2 |
| Thin Section Maximum Length, cm | 46.6 | 37.7 | 44.3 | 61.0 | 18.5 |
| Thin Section Length Minimum cm | 5.5 | 13.9 | 5.2 | 11.5 | 5.2 |
| Randomness Length VTL, Thin Section Maximum/Minimum | 8.5 | 2.7 | 8.5 | 5.3 | 3.5 |
| Slub % = Average Length Slub/Length of Thin + Slub Section | 36.5% | 39% | 35% | 30% | 33% |
| Slub Denier | 875 | 931 | 978 | 818 | 587 |
| Thin Section Denier | 421 | 422 | 429 | 398 | 414 |
| Denier Ratio = Denier Thick/ Denier Thin Section | 2.1 | 2.2 | 2.3 | 2.15 | 1.4 |
| Draw Ratio (DR) | 2.5 | 3.0 | 3.0 | 3.5 | 3.5 |
| Temperature, ° C. | 6 | 6 | 6 | 6 | 6 |
| Residence Time in Seconds | .013 | .051 | .03 | .051 | .013 |

In the following Table II a 1-inch cold stainless steel pin was used to draw yarn under the described test It can be seen that the drawn yarn gave moderately good breaking strength, but poor tear resistance. The undrawn yarns gave improved tear resistance but very high elongation. The thick-thin yarn gave better tear strength with only a slight increase in elongation.

over, fabrics having less than about 3 oz/yd.$^2$ of thick-thin fibers do not differ substantially from fabrics made of conventional fibers. Preferably, the most improved fabrics composed of the fibers of this invention weigh about 5 to 7 oz/yd.$^2$.

TABLE II

PRODUCT PROPERTIES OF NOVELTY YARNS PREPARED AT DIFFERENT CONDITIONS WITH DIFFERENT YARN PROPERTIES

| Example No. | Nominal Sample Denier Thick (Slub) | Thin | Draw Ratio | *1 Slub, % $(L_s/L_s+L_t)$ | Denier Ratio Average $(D_s/D_t)$ | Draw Speed ft./min. | Polymer Type | Draw Pin Temp. |
|---|---|---|---|---|---|---|---|---|
| 7 | 1100 | 430 | 2.0 | 53 | 2.35 | 550 | Nylon 6 | 6° C. |
| 8 | 1000 | 430 | 2.5 | 47 | 2.28 | 550 | Nylon 6 | 6° C. |
| 9 | 950 | 450 | 3.0 | 38.5 | 2.18 | 520 | Nylon 6 | 8° C. |
| 10 | 590 | 415 | 3.5 | 40 | 1.39 | 520 | Nylon 6 | 8° C. |
| 11 | 330 | 150 | 2.0 | 34 | 2.2 | 550 | Polyester (PET) | −20° C.* |
| 12 | 330 | 140 | 2.5 | 15 | 2.35 | 550 | Polyester (PET) | −20° C.* |
| 13 | 320 | 125 | 3.0 | 9.5 | 2.55 | 550 | Polyester (PET) | −20° C. |
| 14 | 320 | 135 | 2.5 | 26 | 2.35 | 530 | 15% PET/ 85% Nylon 6 Molten Blend | −20° C. |
| 15 | 235 | 125 | 2.5 | 28 | 1.9 | 1062 | 15% PET/ 85% Nylon 6 | −20° C.* |
| 16 | 335 | 118 | 2.5 | 25 | 2.8 | 1062 | Nylon 6 | −20° C.* |
| 17 | 315 | 125 | 2.5 | 35 | 2.5 | 530 | Poly-propylene | 6° C. |

*Yarn was chilled by passage through a zone held at −20° C. at ½ inch from the draw pin which was a ⅜ inch Alsimag ceramic surface pin.
*1 $L_s$ = Length of Slub; $L_t$ = Length of Thin Section.

TABLE III

FABRIC PROPERTIEES

| Yarn Properties & Yarn Drawing Conditions | | | | | | | Slub Description in Fabric Form | | | |
|---|---|---|---|---|---|---|---|---|---|---|
| Example No. | Cold Zone ° C. | (in.) Pin Size | Draw Ratio | Denier Ratio *1 | Draw Zone Length (in.) | Slub Length (in.) | Range of Slub Lengths (in.) | Average Slub Length (in.) | Frequency (Slubs/Knitted) Course, Average) | Slub Pattern & Comments |
| 18 | −6 | 3/8 | 3.2 | 1.4 | 4.0 | 1.5 | 1/8–3/8 | 5/16 | 0.08 *2 | Random, Poor |
| 19 | −2 | 3/8 | 3.2 | 1.6 | 6.0 | 2.2 | 1/8–3/8 | 1/4 | 0.07 *2 | Random, Poor |
| 20 | −8 | 3/8 | 3.2 | 1.02 | 18.0 | 7.0 | 1/8–1 | 3/8 | 0.08 *2 | Random, Poor |
| 21 | −4 | 3/8 | 2.5 | 2.1 | 6.0 | 2.9 | 1/8–3/4 | 3/8 | 3.5 | Random, Excellent |
| 22 | −8 | 3/8 | 2.5 | 2.3 | 18.0 | 8.5 | 1/8–1–3/8 | 3/4 | 2.5 | Random, Excellent |

*1 Denier Ratio = Average Slub Denier Divided by Average Thin Denier.
*2 The low slub frequency may indicate long slubs or visually indistinct slubs. In this caseit is visually indistinct slubs due to low slub size (see 1 above).

To further illustrate differences in properties, a small, heavy weight was dropped from sufficient height to pierce the fabric from the drawn yarn. When the weight was dropped from the same height onto the undrawn yarn fabrics they did not pierce but left a large permanent bulge due to the easy extensibility of the fils. Dropping the weight on the thick-thin yarn fabrics left little, if any, permanent dimple yet resisted piercing as did the undrawn yarns.

Additional non-woven fabrics in heavier weights were made from the thick-thin yarns of this invention in accordance with the procedures of Example 26. It was found that the effectiveness of the thick-thin yarns relating to the improved properties enunciated herein are diminished when employed in fabrics in weights greater than about 8 oz/yd.$^2$ because the free movement of the fibers is somewhat restricted as the thickness and density of the fabric increases beyond such weights. More-

TABLE IV

| Example | 23 Regular Drawn Nylon 6 | 24 Undrawn Nylon 6 | 25 Undrawn Nylon 6 | 26 TT Nylon 6 |
|---|---|---|---|---|
| Weight, oz./yd$^2$ | 22 | 7.5 | 7.8 | 6.63 |
| Breaking strength, lbs. | 13.1 (2.11) | 19.4 (2.59) | 27.5 (3.53) | 16.1 (2.43) |
| Elongation at Break % | 30 | 59 | 114 | 37 |
| Tear strength lbs. | 3.6 (0.58) | 14.1 (1.88) | 23.0 (2.95) | 9.7 (1.46) |

Note:
Numbers in parenthesis are normalized to 1 oz./yd$^2$ level. TT = thick thin Measurements of non-woven fabrics made according to Example 26 in weights of 3 to 8 oz/yd.$^2$ showed property ranges as follows: breaking strength, 6–20 lbs., tear strength, 4.4–12 lbs., elongation, less than 45 percent.

We claim:

1. A process for producing thick-thin filaments composed of randomly spaced portions having varying cross-sectional areas wherein the denier ratio between said large and small portions is about 2.1 to 2.3, which comprises extruding a filament-forming synthetic polycaproamide polymer through an orifice to form a continuous filament, contacting said filament with a cooling device maintained at −4° C. to −8° C. for about 0.5 second to produce a thermal instability in the segment of said filament in contact with said cooling device and immediately drawing said cooled segment at a draw ratio of about 2.5 whereby randomly spaced portions of large and small diameter are produced, said process being further characterized in that the thermal instability and drawing conditions are controlled within the following limits:

(a) $E_D - E_Y = 1.5 \times 10^{-3}$ to $4.5 \times 10^{-3}$ cal/m/den;

(b) $t_c$ = about 0.05 second; and (c) $d_E/d_t = 5 \times 10^2$ to $12 \times 10^3$ cal/gm/sec.

where:

$E_D$ = Internal energy required to draw entire length of filament $E_Y$ = Internal energy of chilled filament $t_c$ = Contact time between filament and chiller $d_E/d_t$ = Rate of heat removal from said filament.

* * * * *